US009221530B2

(12) United States Patent
Bohmann

(10) Patent No.: US 9,221,530 B2
(45) Date of Patent: Dec. 29, 2015

(54) SHIP PROPULSION SYSTEM AND SHIP EQUIPPED THEREWITH

(75) Inventor: Heinz-Jürgen Bohmann, Witten (DE)

(73) Assignee: RENK Aktiengesellschaft, Augsburg (DE)

( * ) Notice: Subject to any disclaimer, the term of this patent is extended or adjusted under 35 U.S.C. 154(b) by 766 days.

(21) Appl. No.: 13/202,864

(22) PCT Filed: Feb. 4, 2010

(86) PCT No.: PCT/DE2010/050004

§ 371 (c)(1),
(2), (4) Date: Oct. 4, 2011

(87) PCT Pub. No.: WO2010/097080

PCT Pub. Date: Sep. 2, 2010

(65) Prior Publication Data

US 2012/0015569 A1 Jan. 19, 2012

(30) Foreign Application Priority Data

Feb. 26, 2009 (DE) ..... 10 2009 010 656

(51) Int. Cl.
*B63H 23/34* (2006.01)
*B63H 21/30* (2006.01)
*B63H 23/32* (2006.01)

(52) U.S. Cl.
CPC ..... *B63H 23/321* (2013.01); *B63H 21/305* (2013.01)

(58) Field of Classification Search
CPC .... B63H 11/08; B63H 23/321; B63H 21/305; B63H 21/03; F16C 17/04; F16C 17/06; F16C 32/06
USPC ..... 440/111, 38, 83, 52
See application file for complete search history.

(56) References Cited

U.S. PATENT DOCUMENTS 4,657,411 A * 4/1987 Bath ..... F16C 17/06 384/303
4,892,417 A * 1/1990 Spargo ..... F16C 32/0692 384/122

(Continued)

FOREIGN PATENT DOCUMENTS

DE 2941916 A * 5/1980
DE 4345126 C1 * 5/1995

OTHER PUBLICATIONS

Taylor, D. A. "Intorduction to Marine Engineering" 1996, Elsevier Butterworth-Heinemann, 2nd ed., Chapter 11—Shafting adn Propellers, pp. 200-203.*

(Continued)

*Primary Examiner* — Anthony Wiest
(74) *Attorney, Agent, or Firm* — Cozen O'Connor

(57) ABSTRACT

Marine propulsion system and ship outfitted therewith, wherein the marine propulsion system has a propulsion element for propelling a ship, a driving engine which is to be flexibly mounted at a hull of the ship for driving the propulsion element, a thrust bearing which is to be rigidly mounted at the hull and which has a thrust bearing shaft having a first end and a second end, a driving engine drivetrain for connecting the driving engine to the first end of the thrust bearing shaft, and a propulsion element drivetrain for connecting the second end of the thrust bearing shaft to the propulsion element, wherein the driving engine drivetrain rigidly connects the driving engine to the first end of the thrust bearing shaft.

5 Claims, 3 Drawing Sheets

(56) References Cited

U.S. PATENT DOCUMENTS

| | | | | |
|---|---|---|---|---|
| 4,915,510 | A * | 4/1990 | Arvidsson | F16C 23/02 384/121 |
| 6,875,067 | B2 * | 4/2005 | Tornblad et al. | 440/83 |
| 6,969,289 | B2 * | 11/2005 | Hultsch et al. | 440/111 |

OTHER PUBLICATIONS

Marine Diesel Engines Installation Handbook, Mar. 2004, Iveco Motors; Retrieved from the Internet on Jan. 15, 2014 http://www.powertechengines.com/IvecoManuals/InstallationManual-MarineDieselEngines-P3D63Z001E-Mar04.pdf See pp. 53-55 on Engine Installation (excerpts included in office action).*

* cited by examiner

SHIP PROPULSION SYSTEM AND SHIP EQUIPPED THEREWITH

PRIORITY CLAIM

This is a U.S. national stage of application No. PCT/DE2010/05004, filed on 4 Feb. 2010. Priority is claimed on the following application: Country: Germany, Application No.: 10 2009 010 656.1, Filed: 26 Feb. 2009, the content of which is incorporated herein by reference.

FIELD OF THE INVENTION

The present invention is directed to a marine propulsion system having a driving engine drive train connecting the drive engine to the thrust bearing shaft and to a ship or boat outfitted with a marine propulsion system of this kind.

BACKGROUND OF THE INVENTION

A marine propulsion system of the type mentioned above is known from DE 43 45 126 C1. However, in this marine propulsion system a resilient coupling is provided in the driving engine drivetrain so that the driving engine drivetrain elastically or flexibly connects the driving engine to a first end of a thrust bearing shaft provided in a thrust bearing.

Another marine propulsion system of this kind is known from DE 29 41 916 A1.

SUMMARY OF THE INVENTION

It is an object of the present invention to provide an economical and compact marine propulsion system having an elastically supported driving engine and a fixedly mounted thrust bearing. The present invention has the further object of providing a ship or boat outfitted with a marine propulsion system of this kind.

According to a first aspect of the present invention, a marine propulsion system is provided which has a propulsion element for driving a ship, a driving engine which is to be flexibly or elastically mounted at a hull of the ship for driving the propulsion element, a thrust bearing which is to be rigidly mounted at the hull and which has a thrust bearing shaft having a first end and a second end, a driving engine drivetrain for connecting the driving engine to the first end of the thrust bearing shaft, and a propulsion element drivetrain for connecting the second end of the thrust bearing shaft to the propulsion element. In the marine propulsion system according to the present invention the driving engine drivetrain connects or couples the driving engine rigidly, particularly directly, to the first end of the thrust bearing shaft.

The solution according to the present invention provides an economical and compact marine propulsion system. Due to the fact that the driving engine drivetrain connects the driving engine rigidly, i.e., axially rigidly and radially rigidly, to the first end of the thrust bearing shaft, additional couplings, particularly additional resilient or flexible couplings, can be dispensed with in the driving engine drivetrain in favor of cost efficiency. In structural respects, this also allows a shorter, radially smaller and, therefore, compact construction of the driving engine drivetrain, which results in a reduced space requirement in the engine room of the ship.

According to the present invention, the driving engine can be formed, e.g., by an electric motor or also by a combustion engine, e.g., a diesel engine, a gasoline engine, or a gas engine.

According to an embodiment of the marine propulsion system according to the present invention, the driving engine drivetrain is formed by an individual, one-piece driving engine shaft.

Therefore, the driving engine drivetrain can be constructed more economically and compactly. Further, the simple implementation having only one individual one-piece driving engine shaft which is connected to a driven shaft of the driving engine and to the first end of the thrust bearing shaft, e.g., by respective flange connections, facilitates servicing and improves ease of assembly of the marine propulsion system according to the present invention.

According to another embodiment of the marine propulsion system according to the present invention, the thrust bearing has a housing and guide means for rotatable axial guiding of the thrust bearing shaft and damping elements for damping vibrations, which damping elements are arranged between the guide means and the housing.

This construction of the thrust bearing of the marine propulsion system according to the present invention advantageously achieves an insulation of structure-borne sound between the thrust bearing and the hull by means of the arrangement of the damping elements between the guide means and the housing.

Further, within certain limits, this construction of the thrust bearing of the marine propulsion system according to the present invention allows a tilting of the thrust bearing shaft with respect to its axial direction by means of a radial displacement of the driving engine and, therefore, of the first end of the thrust bearing shaft. This is made possible on the one hand by a predetermined elasticity or flexibility of the damping elements which are preferably produced from an elastomer material and, on the other hand, by the hydraulic unit connected in a ring main and by a predetermined elastic flexibility of the thrust bearing shaft.

According to another embodiment of the marine propulsion system according to the present invention, the damping elements have a determined Shore hardness, and the damping elements are received in the housing such that they can be dismantled so that the damping elements can be exchanged for damping elements having a different Shore hardness.

In this way, the damping action of the damping elements, particularly also their elasticity or flexibility, can be adjusted or changed in a simple manner by exchanging the damping elements of one Shore hardness for damping elements of another Shore hardness.

The housing preferably has openings which are closed by respective covers and by means of which the damping elements can be exchanged without completely dismantling the thrust bearing.

According to yet another embodiment of the marine propulsion system according to the present invention, the damping elements are pre-loaded relative to the guide means, and a respective pre-loading force of the damping elements can be varied.

Accordingly, the damping action and tilting capability can be adjusted or altered additionally in a simple manner by altering the respective pre-loading force on the damping elements.

According to an embodiment of the marine propulsion system according to the present invention, the thrust bearing is a sliding bearing, wherein sliding surfaces of the guide means are supported at the housing of the thrust bearing by the damping elements. The guide means preferably have slide shoes which contact the sliding surfaces and which are supported at the housing by the damping elements.

According to another embodiment of the marine propulsion system according to the present invention, a hydraulic unit is provided between the respective slide shoe and the respective damping element for further damping. The respective hydraulic units are preferably hydraulically connected to one another by a ring main.

According to a second aspect of the present invention, a ship is provided which is outfitted with a marine propulsion system according to one, more, or all of the above-described embodiments according to the present invention in any conceivable combination.

Within the meaning of the present invention, the term "ship" includes any watercraft, e.g., also submarines, yachts, and naval vessels, which make use of Archimedes' principle for floating in or on the water.

BRIEF DESCRIPTION OF THE DRAWINGS

The present invention will be described in more detail in the following with reference to preferred embodiments and the accompanying drawings in which.

DETAILED DESCRIPTION OF THE PRESENTLY PREFERRED EMBODIMENTS

Figure 1:
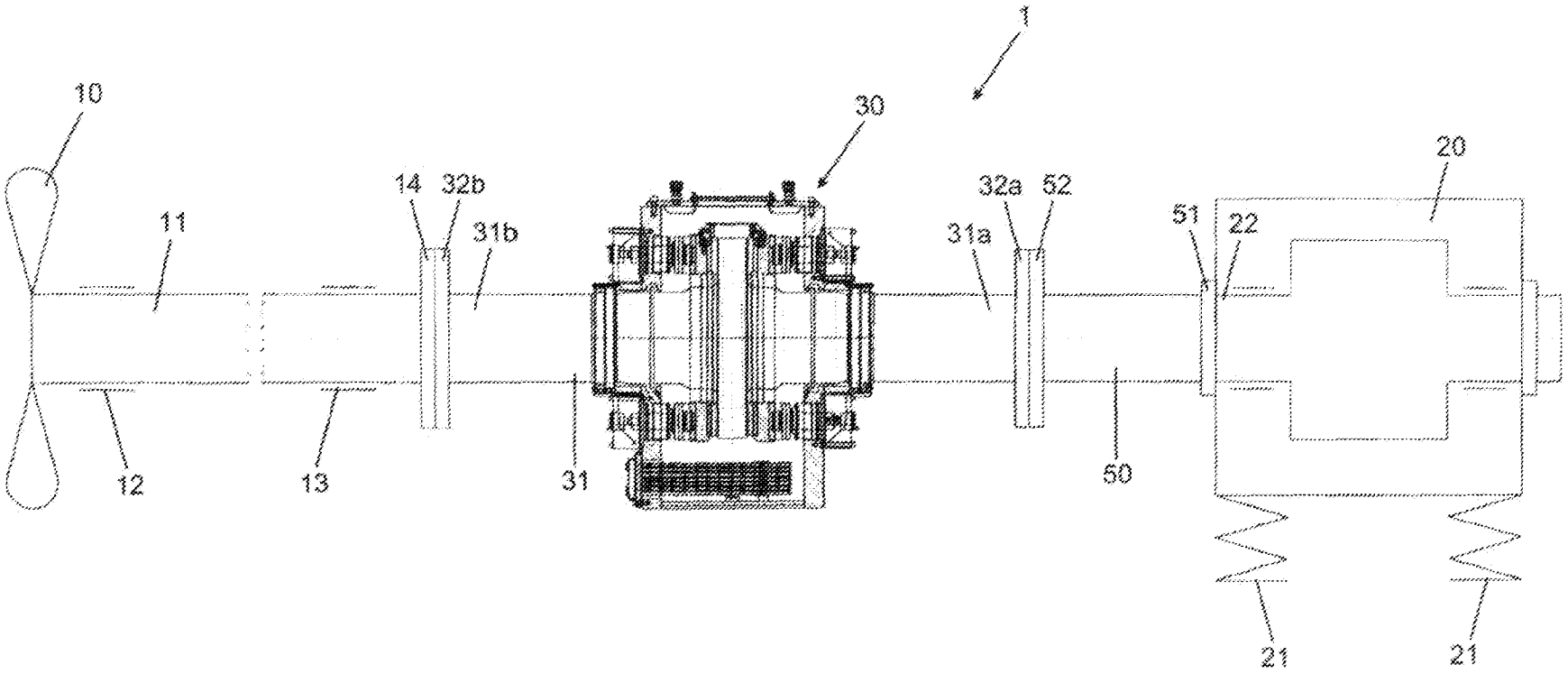
FIG. 1 is a schematic view of a marine propulsion system according to an embodiment of the present invention.

FIG. 1 shows a marine propulsion system 1 according to an embodiment of the present invention which is integrated in a ship (not shown in its entirety and not designated separately). According to this embodiment of the present invention, the ship is constructed as a submarine.

The marine propulsion system 1 has a propulsion element 10 constructed as a propeller or screw propeller for propelling the ship, a driving engine 20, constructed in this instance as an electric motor, for driving the propulsion element 10 in rotation, and a thrust bearing 30.

The thrust bearing 30 is mounted or supported via fixed bearings 40 (see FIG. 3) rigidly on a mount (not designated) which is provided at a hull (not shown) of the ship. The thrust bearing 30 has a thrust bearing shaft 31 having a first end 31*a* and a second end 31*b*. A connection flange 32*a* and 32*b*, respectively, is provided at each end of the thrust bearing shaft 31.

The propulsion element 10 is arranged at one end of a propulsion element shaft 11 which is mounted or supported at the hull by radial bearings 12, 13. A connection flange 14 is provided at the other end of the propulsion element shaft 11 and is in a rigid driving connection with the connection flange 32*b* provided at the second end 31*b* of the thrust bearing shaft 31 by means of screw connections, not shown. The propulsion element shaft 11 accordingly forms a propulsion element drivetrain for connecting the second end 31*b* of the thrust bearing shaft 31 to the propulsion element 10.

The driving engine 20 is flexibly mounted or supported at the mount provided at the hull of the ship by means of resilient or flexible bearings 21 so that structure-borne sound generated by the driving engine 20 or vibrations generated by the latter are decoupled from the hull and are transmitted to the latter minimally or not at all.

Further, the driving engine 20 has a driven shaft 22 to which an individual, one-piece driving engine shaft 50 is flanged by means of a flange connection 51. Another connection flange 52 is provided at the end of the driving engine shaft 50 remote of the driven shaft 22. This connection flange 52 is in a rigid driving connection with the connection flange 32*a* provided at the first end 31*a* of the thrust bearing shaft 31 by means of screw connections, not shown. Accordingly, the driving engine shaft 50 forms a driving engine drivetrain for connecting the driving engine 20 to the first end 31*a* of the thrust bearing shaft 31.

Therefore, as can be gathered from the preceding description, the driving engine shaft 50 or driving engine drivetrain connects the driving engine 20 directly and rigidly to the first end 31*a* of the thrust bearing shaft 31.

The thrust bearing 30 will now be described in more detail with reference to FIGS. 2 and 3.

Figure 2:
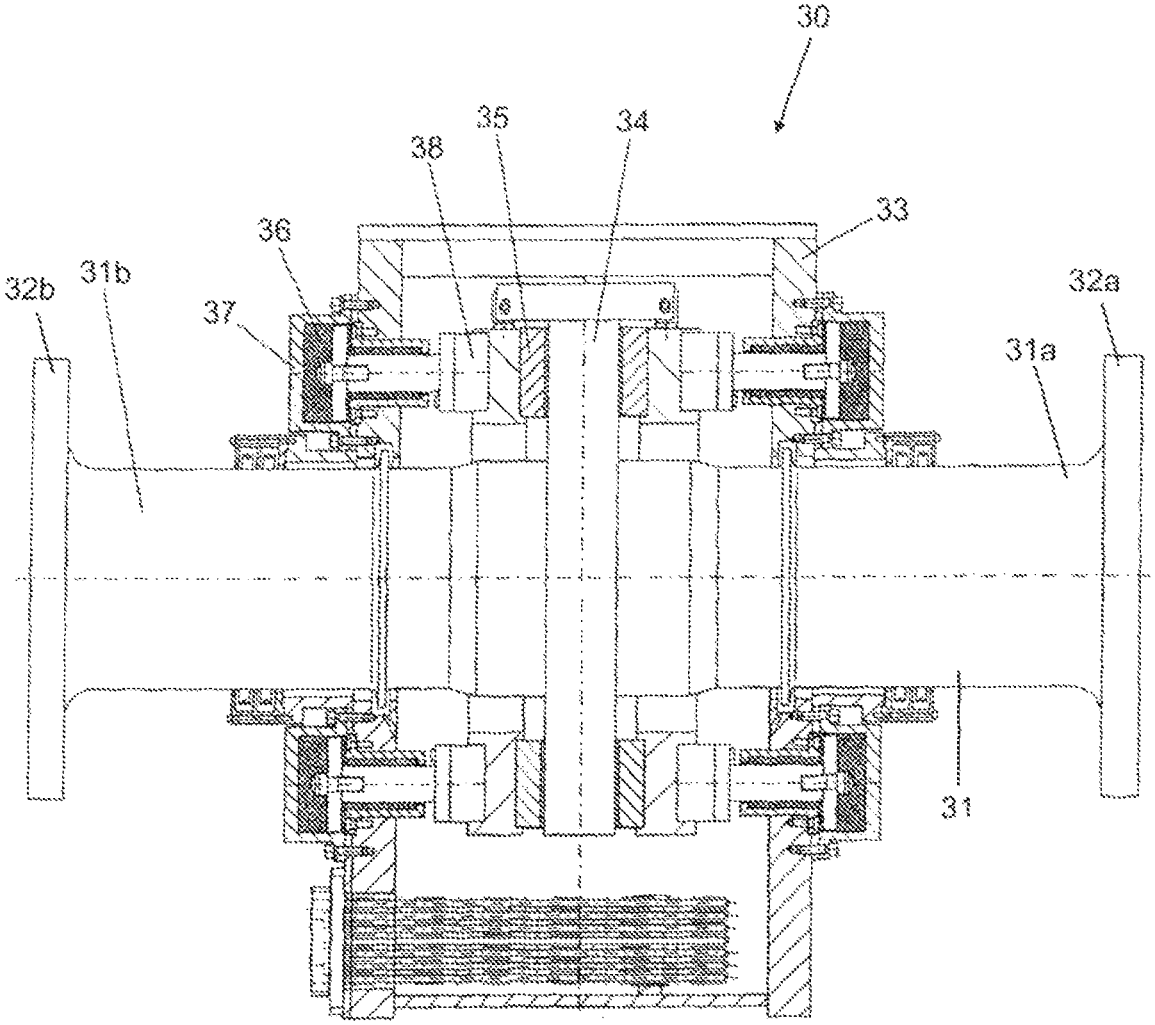
FIG. 2 is a schematic enlarged view of the thrust bearing of the marine propulsion system of FIG. 1.

As can be seen from the sectional diagram in FIG. 2, the thrust bearing 30 has a housing 33 which is rigidly connected, i.e., without the intermediary of vibration-damping materials, to the mount provided at the hull by fixed bearings 40. The thrust bearing shaft 31 extends through the housing 33 and has a shaft collar 34 which is supported at both sides by slide shoes 35; i.e., a plurality of slide shoes 35 which are arranged so as to encircle the thrust bearing shaft 31 and are guided so as to be axially movable in the housing 33 are provided on both sides of the shaft collar 34.

Forces acting on the thrust bearing shaft 31 axially and from left to right with reference to FIG. 2 are transmitted via the shaft collar 34 to the slide shoes 35 which are arranged next to the collar 34 on the right-hand side referring to FIG. 2. An oil film is formed, e.g., hydrodynamically or hydrostatically, between the slide shoes 35 and the shaft collar 34 in a well-known manner in order to separate the surfaces. Forces acting axially on the thrust bearing shaft 31 in the reverse direction are transmitted to the housing 33 by the slide shoes 35 which are arranged to the left of the shaft collar 34 with reference to FIG. 2.

The slide shoes 35 introduce the supporting force into the housing 33 via damping elements 36. The damping elements 36 are each arranged between the slide shoe 35 and housing 33 at the side remote of the shaft collar 34. The damping elements 36 are produced from an elastomer material and can be pre-loaded differently in the housing 33 so that the damping action can be adjusted to predeterminable values.

Further, the damping elements 36 can be exchanged for damping elements 36 having different Shore hardness so that the damping action can also be adjusted in a predetermined manner.

By combining damping elements 36 of different Shore hardness with different pre-loading, the damping action can be changed within a wide range of adjustment and an optimal structure-borne sound insulation can be achieved between the internal parts of the bearings and the housing 33 for many applications.

The exchange of damping elements 36 is carried out by means of covers 37 which are screwed to the housing 33 from the outer side and which can consequently be dismantled easily. Consequently, the thrust bearing 30 need not be dismantled in its entirety for this purpose.

The thrust bearing 30 damps vibrations in axial direction and interrupts the transmission of structure-borne sound, particularly drive noises generated by the driving engine 20.

A substantial advantage of the thrust bearing 20 consists in that drive vibrations are damped directly where they are introduced into the thrust bearing 30. To this end, the shaft collar 34 is connected to the housing 33 of the thrust bearing 30 with the intermediary of vibration-damping material layers. Further, the thrust bearing can receive or absorb both axial and radial movements or displacements of the elastically mounted driving engine 20 due to its design according to the present invention.

As can be seen from FIG. 2, a hydraulic unit 38 is provided and interposed between the respective slide shoe 35 and the respective damping element 36. The respective hydraulic units 38 are connected together by a ring main, not shown. In addition, a hydraulic damping is realized by the respective hydraulic units 38.

Figure 3:
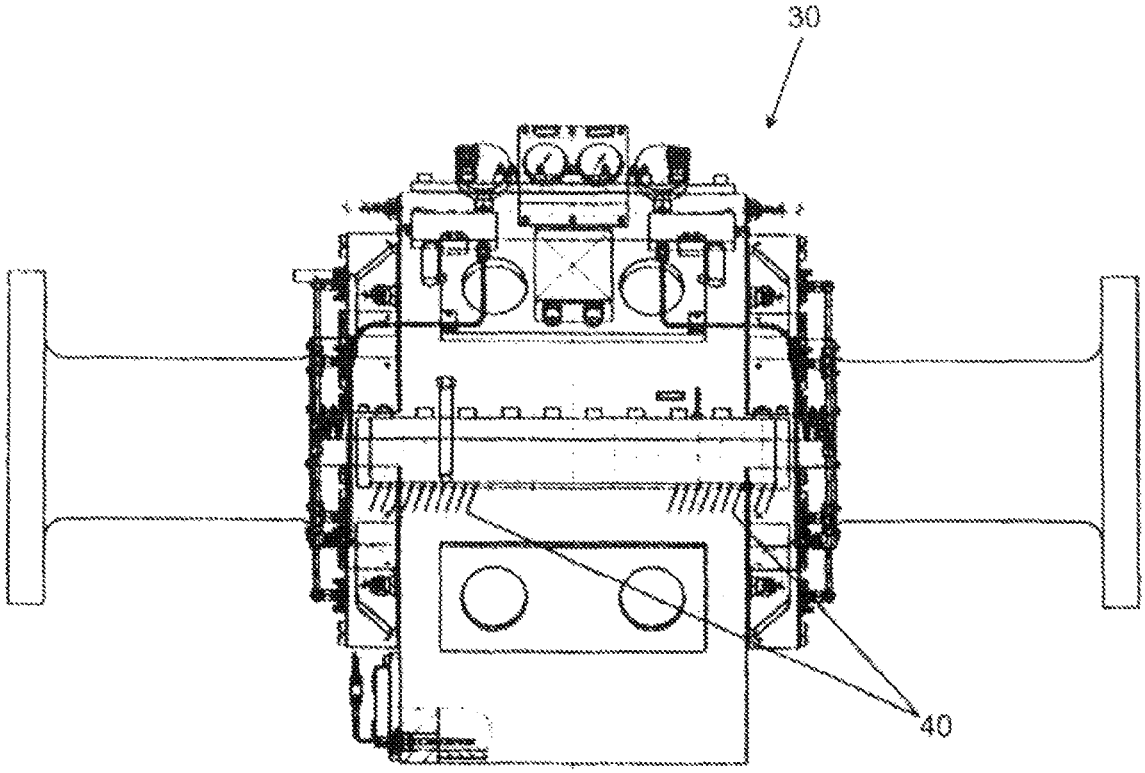
FIG. 3 is a view of the thrust bearing of the marine propulsion system of FIG. 1 which is similar to FIG. 2, wherein the thrust bearing is viewed from a different direction.

FIG. 3 shows the thrust bearing 30 from a different direction than that in FIG. 2. The fixed bearings 40 are shown.

The invention is not limited by the embodiments described above which are presented as examples only but can be modified in various ways within the scope of protection defined by the appended patent claims.

The invention claimed is:

1. Amarine propulsion system comprising:

a propulsion element (10) for propelling a ship;

a driving engine (20) elastically mounted at a hull of the ship for driving said propulsion element (10);

a thrust bearing housing (33) including a thrust bearing (30) rigidly mounted at the hull;

a thrust bearing shaft (31) having a first end (31*a*) and a second end (31*b*);

a driving engine drivetrain for connecting said driving engine (20) to said first end (31*a*) of said thrust bearing shaft (31);

a propulsion element drivetrain (11) for connecting said second end (31*b*) of said thrust bearing shaft (31) to said propulsion element (10); said driving engine drivetrain rigidly and directly connecting said driving engine (20) to said first end (31*a*) of said thrust bearing shaft (31);

a plurality of moveable slide shoes (35) encircling said thrust bearing shaft (31);

damping elements (36) arranged between said plurality of slide shoes (35) and said thrust bearing housing (33), said thrust bearing housing (33) having an opening therein permitting damping elements (36) of one Shore hardness to be exchanged for damping elements of a different Shore hardness; and a plurality of hydraulic units (38) interposed between said plurality of slide shoes (35) and said damping elements (36).

2. The marine propulsion system according to claim 1, wherein said driving engine drivetrain is formed by an individual, one-piece driving engine shaft (50).

3. The marine propulsion system of claim 1, wherein said driving engine drive train is axially and radially rigidly connecting said driving engine (20) to said first end (31*a*) of said thrust bearing shaft (31).

4. A ship having amarine propulsion system comprising:

a propulsion element (10) for propelling a ship;

a driving engine (20) elastically mounted at a hull of the ship for driving said propulsion element (10);

a thrust bearing (30) rigidly mounted at the hull;

a thrust bearing shaft (31) having a first end (31*a*) and a second end (31*b*);

a driving engine drivetrain for connecting said driving engine (20) to said first end (31*a*) of said thrust bearing shaft (31);

a propulsion element drivetrain for connecting said second end (31*b*) of said thrust bearing shaft (31) to said propulsion element (10); said driving engine drivetrain rigidly and directly connecting said driving engine (20) to said first end (31*a*) of said thrust bearing shaft (31);

a plurality of axially moveable slide shoes (35) encircling said thrust bearing shaft (31);

damping elements (36) arranged between said plurality of slide shoes (35) and said thrust bearing housing (33), said thrust bearing housing (33) having an opening therein permitting damping elements (36) of one Shore hardness to be exchanged for damping elements of a different Shore hardness; and a plurality of hydraulic units (38) interposed between said plurality of slide shoes (35) and said damping elements (36).

5. A ship having amarine propulsion system comprising:

a propulsion element (10) for propelling a ship;

a driving engine (20) elastically mounted at a hull of the ship for driving said propulsion element (10);

a thrust bearing rigidly mounted at the hull;

a thrust bearing shaft (31) having a first end (31*a*) and a second end (31*b*);

a driving engine drivetrain for connecting said driving engine (20) to said first end (31*a*) of said thrust bearing shaft (31);

a propulsion element drivetrain for connecting said second end (31*b*) of said thrust bearing shaft (31) to said propulsion element (10); said driving engine drivetrain rigidly and directly connecting said driving engine (20) to said first end (31*a*) of said thrust bearing shaft (31), wherein said driving engine drivetrain is formed by an individual, one-piece driving engine shaft (50);

a plurality of axially moveable slide shoes (35) encircling said thrust bearing shaft (31);

damping elements (36) arranged between said plurality of slide shoes (35) and said thrust bearing housing (33), said thrust bearing housing (33) having an opening therein permitting damping elements (36) of one Shore hardness to be exchanged for damping elements of a different Shore hardness; and a plurality of hydraulic units (38) interposed between said plurality of slide shoes (35) and said damping elements (36).

* * * * *